US005718295A

United States Patent [19]

Trahan

[11] Patent Number: 5,718,295

[45] Date of Patent: Feb. 17, 1998

[54] GROUND LEVELLING BLADE

[75] Inventor: Michel Trahan, Malartic, Canada

[73] Assignee: Trahan International Ltd., Quebec, Canada

[21] Appl. No.: 648,185

[22] PCT Filed: Nov. 8, 1995

[86] PCT No.: PCT/CA95/00639

§ 371 Date: Jul. 22, 1996

§ 102(e) Date: Jul. 22, 1996

[87] PCT Pub. No.: WO96/23128

PCT Pub. Date: Jan. 8, 1996

[30] Foreign Application Priority Data

Jan. 24, 1995 [CA] Canada ..... 2,141,021

[51] Int. Cl.[6] ..... A01B 31/00

[52] U.S. Cl. ..... 172/684.5; 172/781; 172/771; 172/701.1; 172/26.5

[58] Field of Search ..... 172/777, 778, 172/779, 780, 781, 199, 811, 814, 816, 309, 701.1, 4.5, 26.5, 72, 189, 197, 799.5, 684.5

[56] References Cited

U.S. PATENT DOCUMENTS

| | | | |
|---|---|---|---|
| 1,291,594 | 1/1919 | Monroe | 172/684.5 |
| 1,347,485 | 7/1920 | Allyn | 172/684.5 |
| 1,580,142 | 4/1926 | Lamoreaux et al. | 172/684.5 |
| 1,721,075 | 7/1929 | Hargleroad | 172/684.5 |
| 1,798,739 | 3/1931 | Hoiland | 172/684.5 |
| 2,166,596 | 7/1939 | Johnson | 172/684.5 |
| 2,202,815 | 6/1940 | Partridge | 172/684.5 |
| 2,652,642 | 9/1953 | Gifford et al. | 172/684.5 X |
| 2,902,909 | 9/1959 | Reissinger | 172/684.5 X |
| 2,971,588 | 2/1961 | Schwab | 172/684.5 |
| 4,815,542 | 3/1989 | DePlazes | 172/684.5 X |
| 5,411,102 | 5/1995 | Nickels et al. | 172/781 |
| 5,497,569 | 3/1996 | Byman | 172/684.5 X |

*Primary Examiner*—Terry Lee Melius
*Assistant Examiner*—Victor Batson
*Attorney, Agent, or Firm*—Sterne, Kessler, Goldstein & Fox P.L.L.C.

[57] ABSTRACT

The present invention consists of a mobile device that can be attached to the underside of existing mining machines thus eliminating the large number of ground levelling machines used in the mine, and increasing both air quality and worker productivity. This device, attached to the underside of a mining machine, making it possible to level areas that are inaccessible to conventional graders, and is specially designed for use in such places. Its low profile allows the invention to fit perfectly into the space available beneath such machines, in contrast to conventional equipment normally attached to graders, consisting of a vertical blade that is too large for the space between the front and rear wheels of a mining machine. Moreover, thanks to the positioning of its anchors, the invention adjusts automatically to ground conditions, in contrast to a vertical blade which must be adjusted regularly. Finally, the device requires no mechanical maintenance mad costs less than conventional graders.

11 Claims, 6 Drawing Sheets

GROUND LEVELLING BLADE

BACKGROUND OF THE INVENTION

1. Field of the Invention

The present invention consists of a mobile device for levelling the ground in underground mine passageways, which is attached to the underside of an operating mining machine.

2. Related Art

Techniques currently employed for levelling underground mine passages are inadequate, because none of these techniques is specifically adapted to mining use. With one such technique, the grading machines currently in use for levelling underground passageways cannot enter certain parts of such passages such as the work place, because of their design.

Thus, many such graders are required in order to level a mine floor completely. Using such a great number of machines in underground shafts increases the amount of fuel that is expended, and thus reduces air quality, threatening both the health and the productivity of the workers, all of which represent considerable drawbacks.

Moreover, the purchase and maintenance cost of such graders is very high if they are used solely for ground levelling work.

A second technique uses mobile devices, generally in the form of a vertical blade of the kind that are attached under machines designed for road grading, for example. These devices are too bulky to be installed under mining machines, since the space under such machines is for the most part utilized for other purposes. Furthermore, because the earth surface in underground mines is very uneven, the operator must continuously make adjustments to the height of the blade.

Finally, all the above-cited means have a direct impact on the profitability of the mine, given the number of such machines that is required, and their purchase and maintenance costs.

SUMMARY OF THE INVENTION

The inventor has discovered that these drawbacks can be overcome by using a mobile device as a ground leveller that is attached under an existing mining machine that is used for purposes other than ground levelling. Thus, the large number of graders and therefore the quantity of fuel expended can be eliminated, thereby enhancing air quality and worker productivity. By attaching the device to existing machines used in the mine, all parts of the mine, including the work place, can be levelled, since those machines are already designed to operate there. The low profile of the device allows it to fit perfectly into the space available under mining machines, and the positioning of its anchors is such that the device adjusts itself automatically to all ground conditions. Moreover, the profitability of the mine is improved by the fact that the purchase cost of the device is much less than that of a grader, even where several such devices are needed to perform the work. Finally, the device requires very little maintenance.

BRIEF DESCRIPTION OF THE FIGURES

With respect to the drawings that illustrate the embodiment of the invention.

DETAILED DESCRIPTION OF THE PREFERRED EMBODIMENTS

Figure 1:
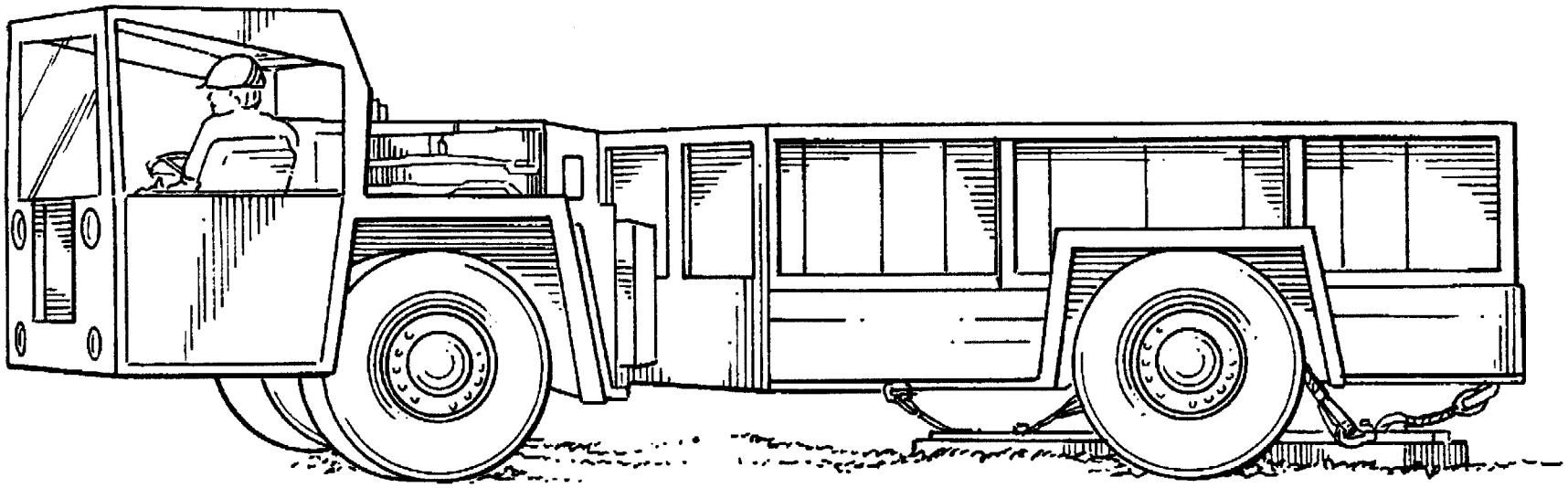
FIG. 1 represents a side view of the machine, with the device attached.
Figure 2:
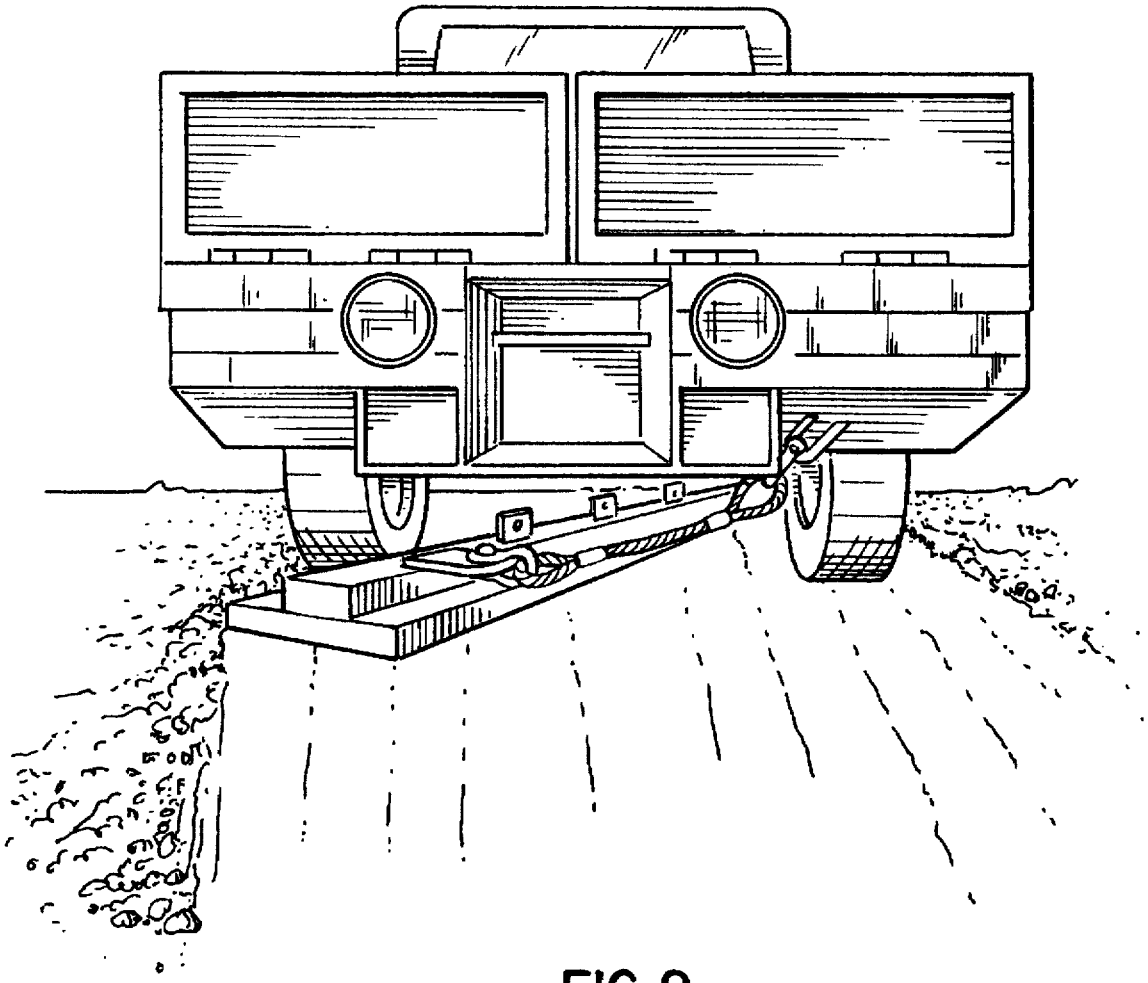
FIG. 2 represents a rear view of the machine, with the device attached.
Figure 3:
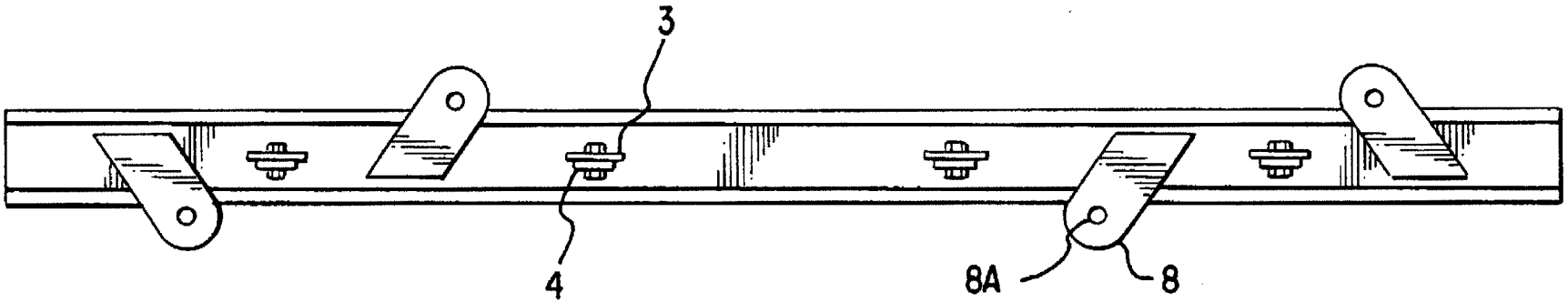
FIG. 3 represents a top view of the device.
Figure 4:
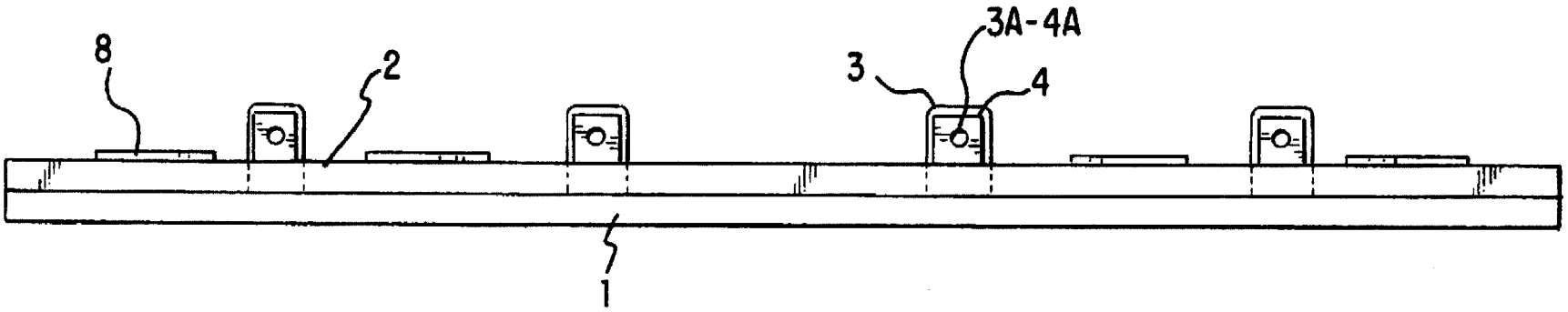
FIG. 4 represents a sectional view of the device along its length.
Figure 5:
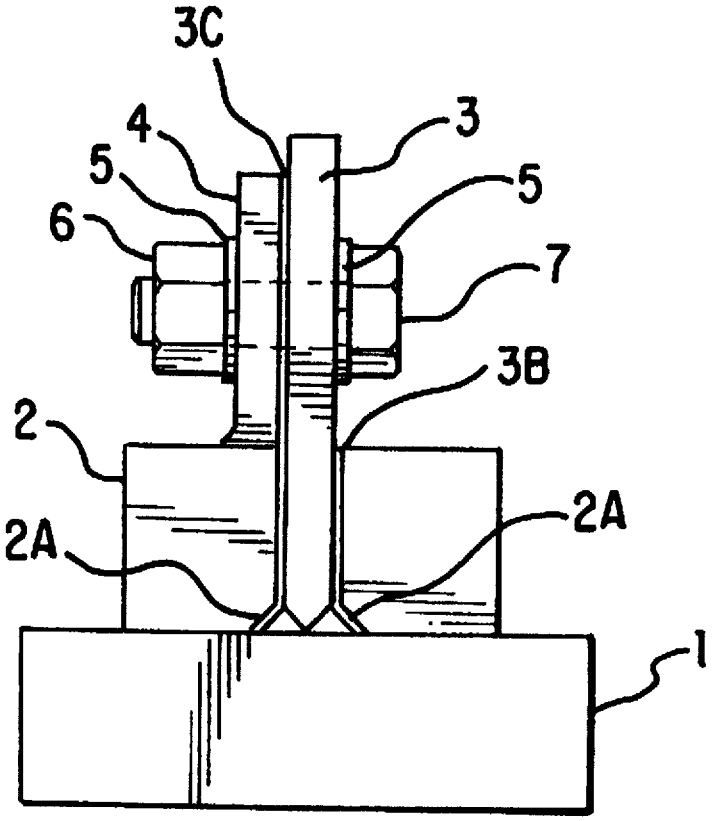
FIG. 5 represents a sectional view of the device along its width.
Figure 6:
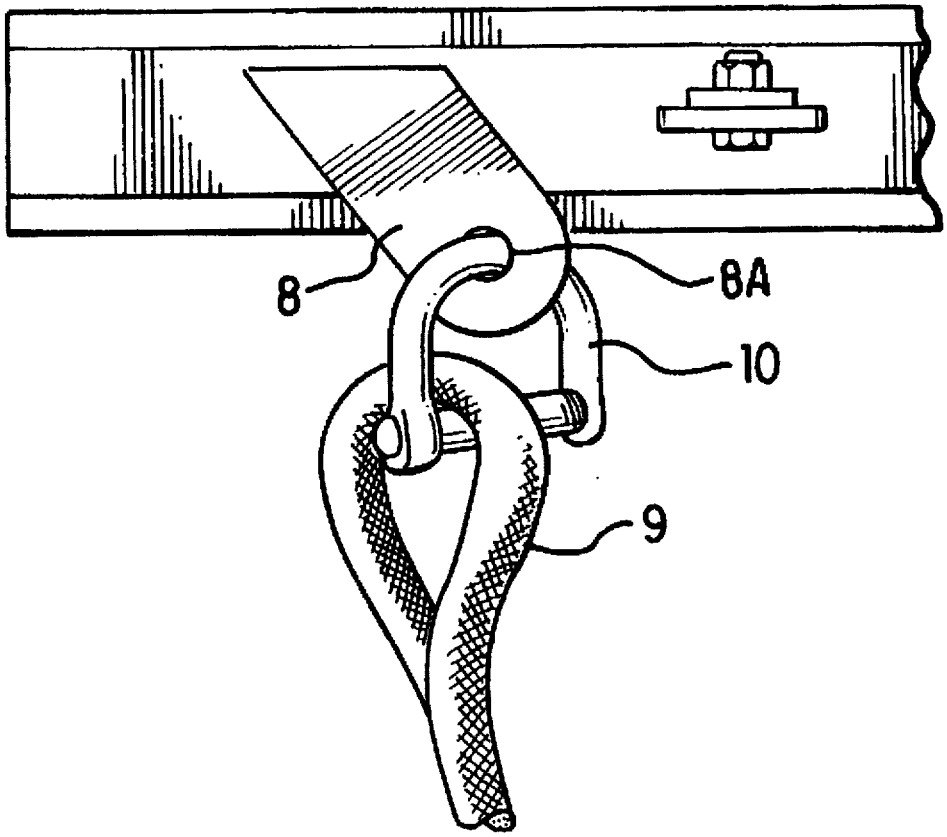
FIG. 6 represents a view of an anchoring point with the coupler and cable attached to it.

The device shown in FIGS. 3 and 4 consist of a lower base 1, rectangular in shape, made of steel, scandium or another material having the same characteristics with respect to weight and resistance to wear, placed on its largest rectangular surface. On this first base lies an upper base 2, which is of the same material as the first, and of the same shape, the same length and arranged in the same manner. These two bases are connected to each other by means of several independent systems, each being composed of parts 2A, 3, 3B, 3C, 4, 5, 6, and 7 (FIG. 5), as subsequently described. A retaining plate 3, square in shape, placed at a vertical, is equipped with a hole 3A in its upper portion. A lower edge of retaining plate 3 is bevelled and is welded to an upper surface of lower base 1, and passes through the upper base 2. Upper base 2 is provided with a chamfer 2A at the point where the lower edge of the retaining plate 3 is welded. A slot 3B is arranged between upper base 2 and retaining plate 3, surrounding the latter. A second retaining plate 4, square in shape, placed at a vertical and not attached, is provided with a hole 4A in its centre and is juxtaposed to retaining plate 3. Retaining plate 4 is smaller in length and in width than retaining plate 3 and serves as a stabilizer between lower base 1 and upper base 2. A slot 3C, which is a continuation of slot 3B, is arranged between parts 3 and 4; a nut 6 and a bolt 7, which passes through holes 3A and 4A, serve to attach plates 3 and 4 together. A steel washer 5 is placed between nut 6 and retaining plate 4, and another steel washer 5 is placed between bolt 7 and retaining plate 3. An anchor 8 made of flat iron (FIG. 3) is attached to upper base 2 by welding. Anchors 8 are arranged alternately on each side of upper base 2. Anchors 8 are each provided with a hole 8A in their extremity to accept a shackle-type coupling 10 (FIG. 6), and are arranged in such a way that holes 8A lie at a diagonal to each other. Each extremity of anchor 8 containing hole 8A extends beyond lower base 1 and upper base 2 to allow coupling 10 to be attached. Cables 9 (FIG. 6) made of steel or another similar material are equipped with couplings 10 at each of their ends. Coupling 10 at one end of cable 9 is attached to anchor 8, and coupling 10 at the other end of cable 9 is attached to the machine. The device is installed beneath the machine by coupling 10 in such a way that one end of the device extends in front of one of the rear wheels (FIG. 2) and the other end extends behind one of the other rear wheels opposite the first, so that the device lies at a diagonal with respect to the machine.

The device according to the invention can be used for levelling any passageways that are travelled by heavy equipment at low speeds, in particular but without limiting the generality of the foregoing, in open-pit mines, lumber yards, foundries, etc. The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

The embodiments of the invention for which an exclusive property right or privilege is claimed are as follows:

1. A device for levelling the ground, comprising:

a lower base made of heavy, wear-resistant material;

an upper base having a slot formed therein;

a first vertically extending retaining plate fixed to said lower base having a hole defined in an upper portion thereof, said retaining plate passing through said slot formed in said upper base;

a second vertically extending retaining plate having a hole defined in a center thereof and juxtaposed with said first retaining plate, wherein said second retaining plate is smaller than said first retaining plate and stabilizes said lower base and said upper base;

attaching means passing through said hole in said first retaining plate and said hole in said second retaining plate for holding said first and second retaining plates together;

anchors fixed on and extending horizontally from alternate sides of said upper base, wherein each of said anchors is provided with a hole in an extremity thereof, said anchors arranged so that said anchor holes extend outwardly beyond said lower base and said upper base and lie diagonally with respect to each other;

a first coupling disposed in each hole in each of said anchors;

a cable attached to said first coupling; and a second coupling attached to said cable for connecting said cable with the machine thereby allowing the machine to pull the device;

wherein the device may be installed beneath the machine in such a way that one end of the device extends in front of the rear wheel of the machine and another end of the device extends behind the rear wheel of the machine whereby the device lies at a diagonal with respect to the machine.

2. A device for levelling the ground as set forth in claim 1, wherein said lower base is rectangular in shape and arranged on its largest rectangular surface and wherein said upper base is rectangular in shape, is the same length as said lower base, and is arranged on its largest rectangular surface.

3. A device for levelling the ground as set forth in claim 1, wherein said lower base and said upper base are made of scandium.

4. A device for levelling the ground as set forth in claim 1, wherein said first vertically extending retaining plate is square in shape and has a beveled lower edge whereby said first vertically extending retaining plate is fixed to said lower base.

5. A device for levelling the ground as set forth in claim 4, further comprising:

a chamfer provided on a lower edge of said slot of said upper base and disposed opposite said beveled lower edge of said first retaining plate.

6. A device for levelling the ground as set forth in claim 4, wherein said second vertically extending retaining plate is square in shape.

7. A device for levelling the ground as set forth in claim 1, further comprising:

a second slot provided between said first retaining plate and said second retaining plate, said second slot being an extension of said first slot.

8. A device for levelling the ground as set forth in claim 1, wherein said cables are made of steel.

9. A device for levelling the ground as set forth in claim 1, wherein said attaching means comprises:

a bolt; and a nut.

10. A device for levelling the ground as set forth in claim 9, wherein said attaching means further comprises:

a washer placed between said nut and said second retaining plate; and a second washer placed between said bolt and said first retaining plate.

11. A device for levelling the ground as set forth in claim 1, further comprising:

anchors welded to said upper base.

* * * * *